United States Patent [19]

Kashio

[11] 4,283,983

[45] Aug. 18, 1981

[54] ELECTRONIC MUSICAL INSTRUMENT

[75] Inventor: Toshio Kashio, Tokyo, Japan

[73] Assignee: Casio Computer Co., Ltd., Tokyo, Japan

[21] Appl. No.: 27,907

[22] Filed: Apr. 6, 1979

[30] Foreign Application Priority Data

Apr. 18, 1978 [JP] Japan ..... 53-45650
Dec. 27, 1978 [JP] Japan ..... 53-164865

[51] Int. Cl.[3] ..... G10H 1/06
[52] U.S. Cl. ..... 84/1.19; 84/1.11
[58] Field of Search ..... 84/1.01, 1.11–1.13, 84/1.19, 1.21, 1.24–1.27

[56] References Cited

U.S. PATENT DOCUMENTS

| | | | |
|---|---|---|---|
| 3,935,781 | 2/1976 | Katoh et al. | 84/1.11 |
| 3,981,218 | 9/1976 | Luce | 84/1.24 |
| 4,018,125 | 4/1977 | Nishimoto | 84/1.19 |
| 4,129,055 | 12/1978 | Whittington et al. | 84/1.01 |
| 4,147,083 | 4/1979 | Woron et al. | 84/1.01 |
| 4,157,049 | 6/1979 | Watanabe | 84/1.24 |

*Primary Examiner*—S. J. Witkowski
*Attorney, Agent, or Firm*—Frishauf, Holtz, Goodman & Woodward

[57] ABSTRACT

An electronic musical instrument, which enables a player easily to select by operating a switch any of a plural number of tone colors from a large number of tone colors originally preset in the musical instrument in a form of tone color data stored in a memory unit, to thereby more easily carry out a performance within a broadened range of performance techniques.

24 Claims, 12 Drawing Figures

ELECTRONIC MUSICAL INSTRUMENT

BACKGROUND OF THE INVENTION

This invention relates to an electronic musical instrument which makes it possible to preset the tone colors of selected ones of numerous musical instruments.

As a player becomes more skilled in performance, the player generally desires to express his feeling by varying, for example, tone volume, tone quality, and tone color. To meet this requirement, an electronic musical instrument such as an electronic organ is widely accepted which can freely produce numerous tone colors. One known type of electronic musical instrument capable of changing tone colors into desired ones carries out said operation by a proper combination of draw bars or tablets. The presetting of tone colors generally involves complicated operations and substantially fails to be quickly carried out during performance. Even where said presetting is effected, it is only possible to preset long tones having a considerable duration. Further, an electronic musical instrument which is provided with a plurality of stop switches can indeed preset a tone color by a single operation during performance. However, this type of electronic musical instrument has the drawbacks that as tone colors to be preset increase in number, a larger number of stop switches have to be provided, resulting in the complicated arrangement of said stop switches and inconvenience in the selection of tone colors. Another known type of electronic musical instrument is provided with not only ordinary tone color-presetting switches, but also a board in which desired tone colors are previously preset in order to effect the change of tone color during performance. Such type of instrument tends to have a complicated construction and an enlarged size. Moreover, it is undesirable from the standpoint of operation efficiency and cost to mount similar tone color-presetting switches on said board. As described above, the prior art electronic organ, for example, can indeed change tone colors during performance, but is still accompanied with the above-mentioned drawbacks. To date, there has not been developed any compact electronic musical instrument which can freely change tone color during performance by a simple mechanism.

Hitherto, an electronic musical instrument of simple arrangement has also been developed which can easily vary tone colors during performance. This type of electronic musical instrument comprises an M number of memory devices which can store the tone colors of an M number of musical instruments selected from an N number of musical instruments ($N>M>1$). Before performance, a player presets the tone colors of desired musical instruments in said M number of memory devices. At the time of performance, tone color data are read out of said memory devices to carry out a performance with desired tone colors. However, once the M number of memory devices are shut off from a power source, data stored therein are extinguished. Where, therefore, it is desired to produce tone colors of other desired musical instruments, the M number of memory devices have to be supplied again with tone color data, thus complicating the tone color-presetting operation. Further, it is necessary to write tone color data an M number of times in the M number of memory devices, thus causing the writing of tone color data to consume a great deal of time and work.

SUMMARY OF THE INVENTION

This invention has been accomplished in view of the drawbacks accompanying the electronic musical instruments developed to date, and is intended to provide an electronic musical instrument of very simple arrangement which comprises a memory section capable of digitally storing coded signals denoting the tone colors of various musical instruments, and wherein the tone colors of an M number of musical instruments selected from those of an N number of musical instruments originally provided for said electronic musical instrument are automatically preset in an M number of memory devices.

To attain the above-mentioned object, this invention provides an electronic musical instrument which comprises means for presetting tone colors of various musical instruments; a memory device having a plurality of memory units for electronically storing tone color data being preset by tone color-presetting means; "write"-instructing means for causing any one of the plural memory units to be supplied with tone color data being preset by said tone color-presetting means; and "read"-instructing means for causing preset tone color data to be read out of any one of the plural memory means for performance. With the electronic musical instrument of this invention, a player causes, before performance, tone color data of plural musical instruments to be stored in a plurality of memory units. During performance, therefore, the player can change the currently played tone color to that preset in any of the plural memory units. An electronic musical instrument embodying this invention which is constructed as described above can simplify the arrangement of the prior art switches and consequently be rendered compact. The present electronic musical instrument of simple arrangement enables a player to preset the tone color of a desired musical instrument by a simple operation without taking the complicated steps as in the case with the prior art electronic musical instrument, and is well adapted for practical application. Further, the electronic musical instrument of this invention is provided with an initial tone color-presetting switch, and enables the tone colors of an M number of musical instruments selected from an N number of musical instruments to be preset very easily by a single operation and allows for easy performance.

DETAILED DESCRIPTION

There will now be described by reference to the accompanying drawings an electronic musical instrument embodying this invention. Referring to FIGS. 1 to 7, for example, four types of musical instruments are selected from among a large number of musical instruments. The tone colors of the four selected musical instruments are stored in four memory areas, thereby, enabling a player selectively to produce the tone color of any of said four musical instruments.

Figure 1:
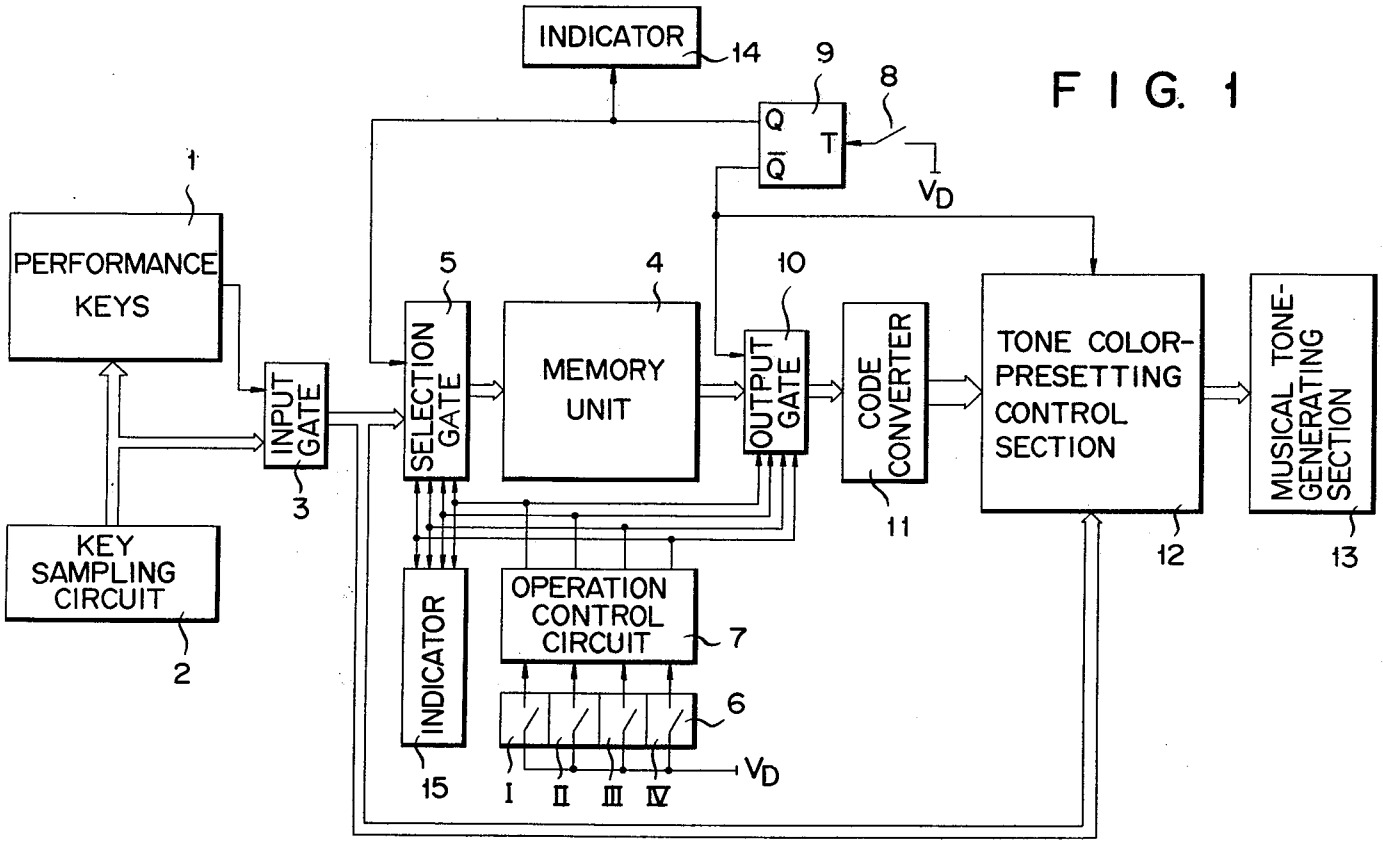
FIG. 1 is a block circuit diagram of a tone color memory device included in an electronic musical instrument embodying this invention.

Referring to FIG. 1, reference numeral 1 denotes a group of for example, 48 performance keys (pitch keys corresponding to 12 scales×4 octaves). Reference numeral 2 is a key sampling circuit, which is formed of a 6-bit binary counter of a 48 scale (corresponding to the 48 performance keys) designed to count clock pulses having a prescribed frequency. A coded signal consisting of output bit signals from said 6-bit binary counter is supplied to a group 3 of input gates and a group 1 of performance keys. The performance keys of the group 1 are supplied with different timing signals corresponding to counts made by the key sampling circuit 2. A timing signal corresponding to a played performance key is supplied to any of the input gate group 3. A 6-bit coded signal delivered from the key sampling circuit 2 is sent forth in response to a played performance key through any input gate of the group 3 to the corresponding tone color selection gate of the group 5 designed to select one of the plural memory areas of a memory unit 4. With the foregoing embodiment, the memory unit 4 has four first to fourth memory areas. A 6-bit coded signal corresponding to a played performance key is written in the selected one of said four memory areas. Any of the tone color selection gate group 5 is supplied with a Q output signal from a flip-flop circuit whose operation is reversed, each time a changeover switch 8 is operated to select a performance mode or a tone color-presetting mode (that is, a mode of specifying the writing of a tone color data in the memory unit 4 or the reading of said tone color data therefrom). Said Q output signal from the flip-flop circuit acts as an instruction for specifying a tone color-presetting mode. While, therefore, an instruction for the presetting of a tone color is supplied to any tone color selection gate of the group 5, the memory area is specified which corresponds to the operated one of the tone color selection switches I to 1V.

Thereafter, a desired performance key is operated, causing the corresponding coded signal delivered from the key-sampling circuit 2 to be written in a specified memory area. The peformance key is used to play a piece of music, during a performance mode in which a $\overline{Q}$ output signal is issued from the flip-flop circuit 9 by the operation of the changeover switch 8. When a Q output signal from said flip-flop circuit 9 specifies a tone color-presetting mode, the performance key is used to preset a tone color. As later described, coded signals corresponding to the performance keys are previously designed to represent different prescribed tone color elements.

Coded signals stored in the four memory areas of the memory unit 4 are conducted to an output gate group 10. When supplied with a performance instruction from the $\overline{Q}$ output terminal of the flip-flop circuit 9, then any output gate of the group 10 sends forth a 6-bit coded signal read out of that of the four memory areas of the memory unit 4 which is specified by any of the tone color-selecting switch sections I, II, III, IV. The 6-bit coded signal is carried to a code converter 11, which is formed of a fixed memory device such as a read only code converter 11, which is formed of a fixed memory device such as a read only memory (abbreviated as "ROM"). The code converter 11 converts the 6-bit coded signal delivered from any output gate of the group 10 into a signal consisting of a larger n number of bits.

Said n-bit signal is supplied to a tone color-presetting control section 12. Each bit of said n-bit signal constitutes a tone color-presetting element, and is supplied to any of the later described control units of the tone color-presetting control section 12 as a prescribed tone color-presetting signal. The tone color-presetting control section 12 is further supplied from any input gate of the group 3 with a coded signal corresponding to an operated performance key and also with an output performance instruction signal from the $\overline{Q}$ output terminal of the flip-flop circuit 9. At the time of performance, a musical tone-generating section 13 produces a musical tone with a tone color defined by the tone color-presetting elements formed of a total n-number of bits and issued from the code converter 11, which is operated in response to a coded signal read out of a memory area previously designated by any of the tone color-specifying switch section I, II, III, IV.

Figure 2:
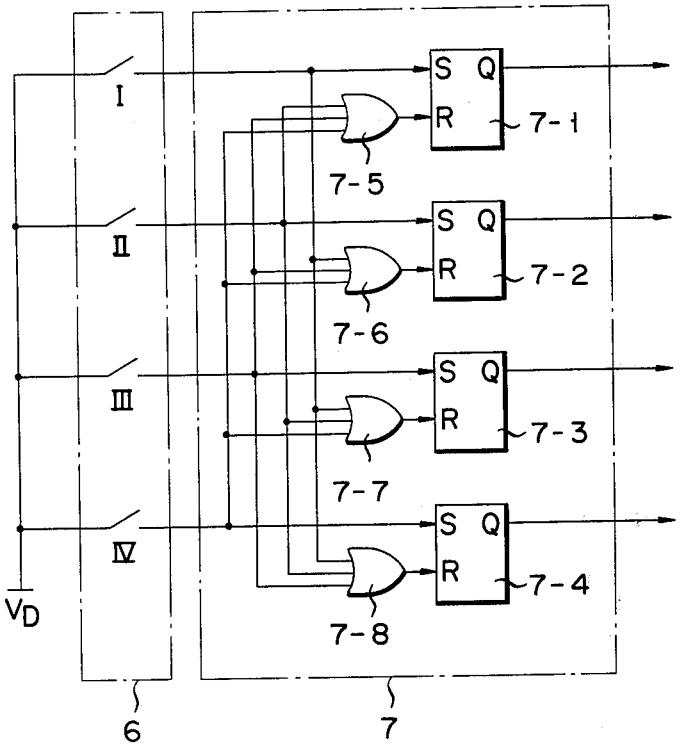
FIG. 2 shows a concrete arrangement of the operation control circuit of FIG. 1.

Referring to FIG. 2 showing the concrete arrangement of the operation control circuit 7, the operation instruction signals sent forth from the tone color-selecting switch sections I, II, III, IV are supplied to the corresponding set input terminals of S-R flip-flop circuits 7-1 to 7-4. Output Q signals from the S-R flip-flop circuits 7-1 to 7-4 are conducted to the tone color selection gate group 5 as memory area-selecting signals. Other switch operation-instructing signals than those issued from the S-R flip-flop circuits 7-1 to 7-4 are supplied as reset signals to the reset terminals thereof through the corresponding OR gates 7-5 to 7-8. Accordingly, only that of the S-R flip-flop circuits 7-1 to 7-4 which corresponds to the operated switch is set, and all the other S-R flip-flop circuits are reset.

Figure 3:
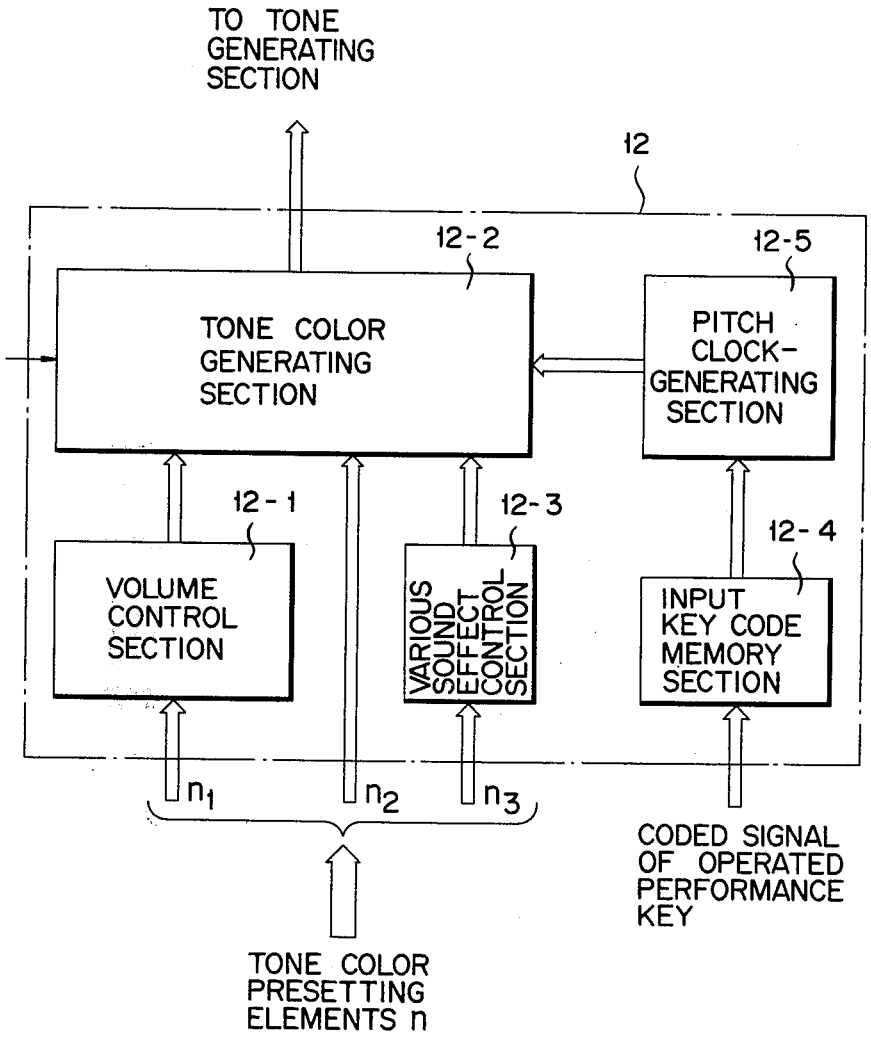
FIG. 3 is a concrete circuit diagram of a tone color-presetting control section of FIG. 1.

Referring to FIG. 3 indicating the concrete arrangement of the tone color-presetting control section 12, signals having an n1 number of bits, an n2 number of bits and an n3 number of bits constituting an output signal from code converter 11 which is formed of an n number of bits to a tone volume control section 12-1, tone color-generating section 12-2 and second effect control section 12-3. An output coded signal from any input gate of the group 3 which corresponds to an operated performance key is supplied to an input key code memory section 12-4. An output performance instruction signal from the $\overline{Q}$ terminal of the S-R flip-flop circuit 9 is conducted to the tone color-generating section 12-2. A coded signal stored in the input key code memory section 12-4 is sent forth to a pitch clock-generating section 12-5, thereby supplying a signal having a clock frequency corresponding to an operated performance key to the tone color-generating section 12-2. Output signals from the tone volume control section 12-1 and sound effect control section 12-3 are supplied to the tone color-generating section 12-2. Accordingly, a musical tone bearing a tone color defined by the tone color presetting elements is sent forth from the musical tone-generating section 13 with a pitch corresponding to an operated performance key only when a performance instruction signal is issued. Referring to the tone volume control section 12-1, the n1-bit tone color-presetting element is designed freely to select the control values of the tone volume control section 12-1, for example, the attack (A), decay (D), sustain (S) and release (R) which have different durations and curve forms. Referring to the tone color-generating section 12-2, the n2-bit tone color-presetting element can freely select the waveforms of musical tone such as a triangular wave, rectangular wave and sawtooth wave, the memory circuit and the tone color-generating circuit constituting said tone color-generating section 12-2 for controlling a filter specifying a flute rate (for example, 4 feet, 8 feet and 16 feet). Referring to second effect control section 12-3, the n3 bit tone color-presetting element can also freely select the kinds of sound effects such as the depth of the tremolo and vibrato, the resonance effect of a synthesizer, the ensemble effect of an electronic organ, the orchestra effect, the repeat effect, and the husky voice effect. Accordingly, a musical tone is controlled to an effective form by the tone color-presetting control section 12 in accordance with tone color-presetting elements of the n-bit code delivered from the code converter 11. What is required in this case is to let the respective performance keys represent the preset tone colors of, for example, the piano, cembalo and oboe. The tone color-generating section 12-2 is operated under the joint control of control signals delivered from the tone volume control section 12-1 and sound effect control section 12-3.

Figure 4:
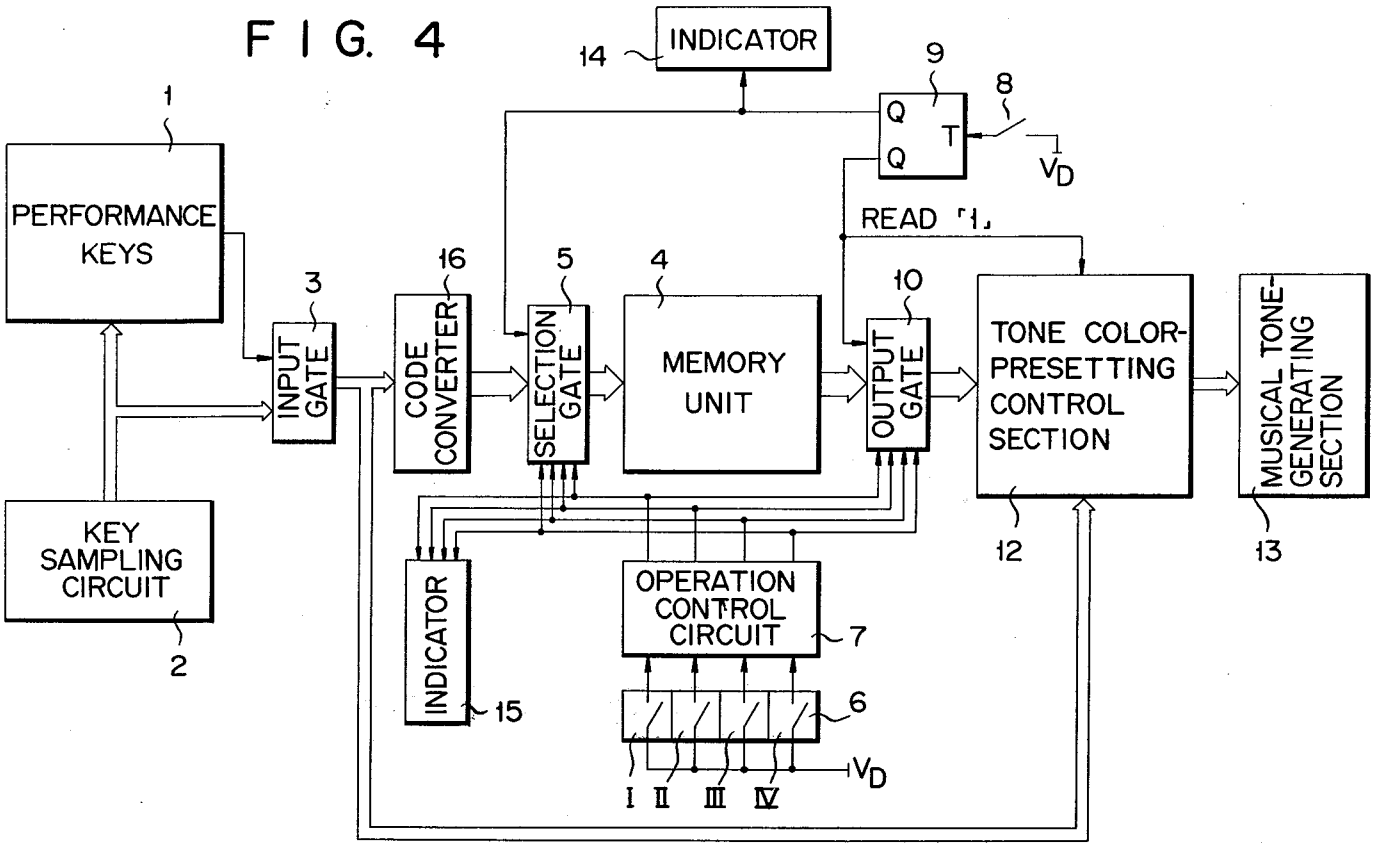
FIGS. 4 to 6 set forth the circuit arrangement of an electronic musical instrument according to other embodiments of this invention.

Referring to FIG. 4, reference numerals 14, 15 denote indicators. The indicator 14 informs a player as to whether a tone color has been preset or not. The indicator 15 shows the type of musical instrument selected by any of the tone color-specifying switches I, II, III, IV.

Before performance, the flip-flop circuit 9 is arranged to have a tone color preset by operation of the changeover switch 8. Where a piece of music being played needs the tones of a plurality of musical instruments, then a player operates the tone color-specifying switch I. Thereafter, the desired one of the performance keys which are previously arranged to represent the tone color-presetting elements is operated, causing the corresponding coded signal to be written in the first memory area of the memory device. Later, the tone color-specifying switch II and any desired performance key are operated, causing the corresponding coded signal to be written in the second memory area. Where further required, a desired coded signal is stored in the memory area specified by the tone color-specifying switch III or IV. A coded signal corresponding to a desired tone-color presetting element is selectively written in the associated memory area in preparation for the case where a player wants during performance to convert the currently played musical tones into these having a different tone color, thereby making an effective dynamic performance. After the coded signal is written in the specified memory area of the memory unit 4, the flip-flop circuit 9 is reversely operated by a changeover switch 8, thereby issuing an instruction to play musical tones having the above-mentioned different tone color and rendering a electronic musical instrument ready for said performance.

When the tone color-specifying switch I, for example, is selected from those I, II, III, IV which are designed to correspond to tone colors played in the initial stage of a performance, then the output terminal of the code converter 11 produces an n-bit tone color-presetting signal corresponding to a coded signal previously stored in the first memory area of the memory unit 4 designated by the selected tone color-specifying switch I. Accordingly, a player can play musical tones with a tone color specified by the tone color-presetting element when operating the performance keys of the group 1. Where the player wants to change the currently played musical tones into those having a different tone color in order to elevate a performance effect, and, immediately before, operates a different desired tone color-specifying switch (for example, a switch III) from the first used switch I, then it is possible to play musical tones having a tone color defined by a tone color-presetting element corresponding to a coded signal stored in the third memory area designated by said third tone color-specifying switch III.

Figure 5:
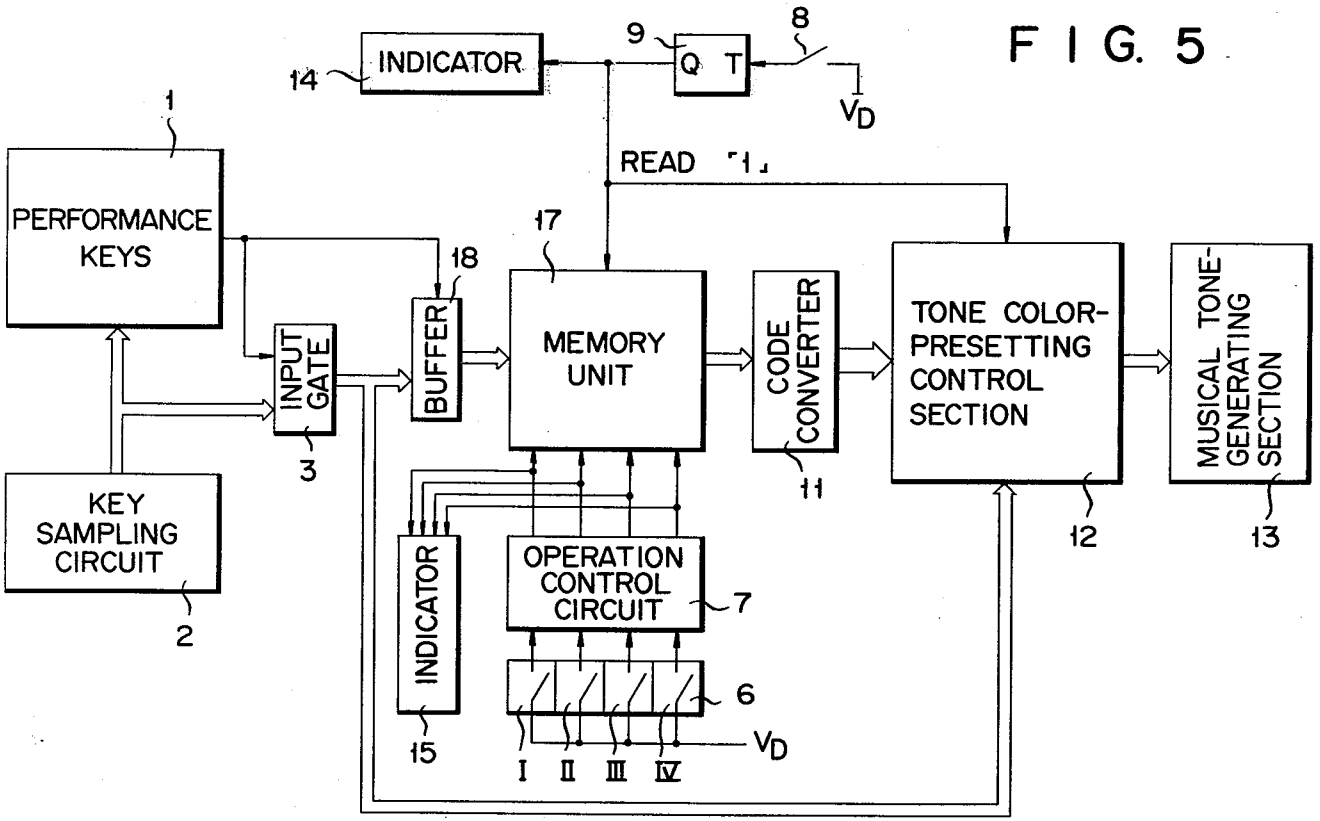
Figure 6:
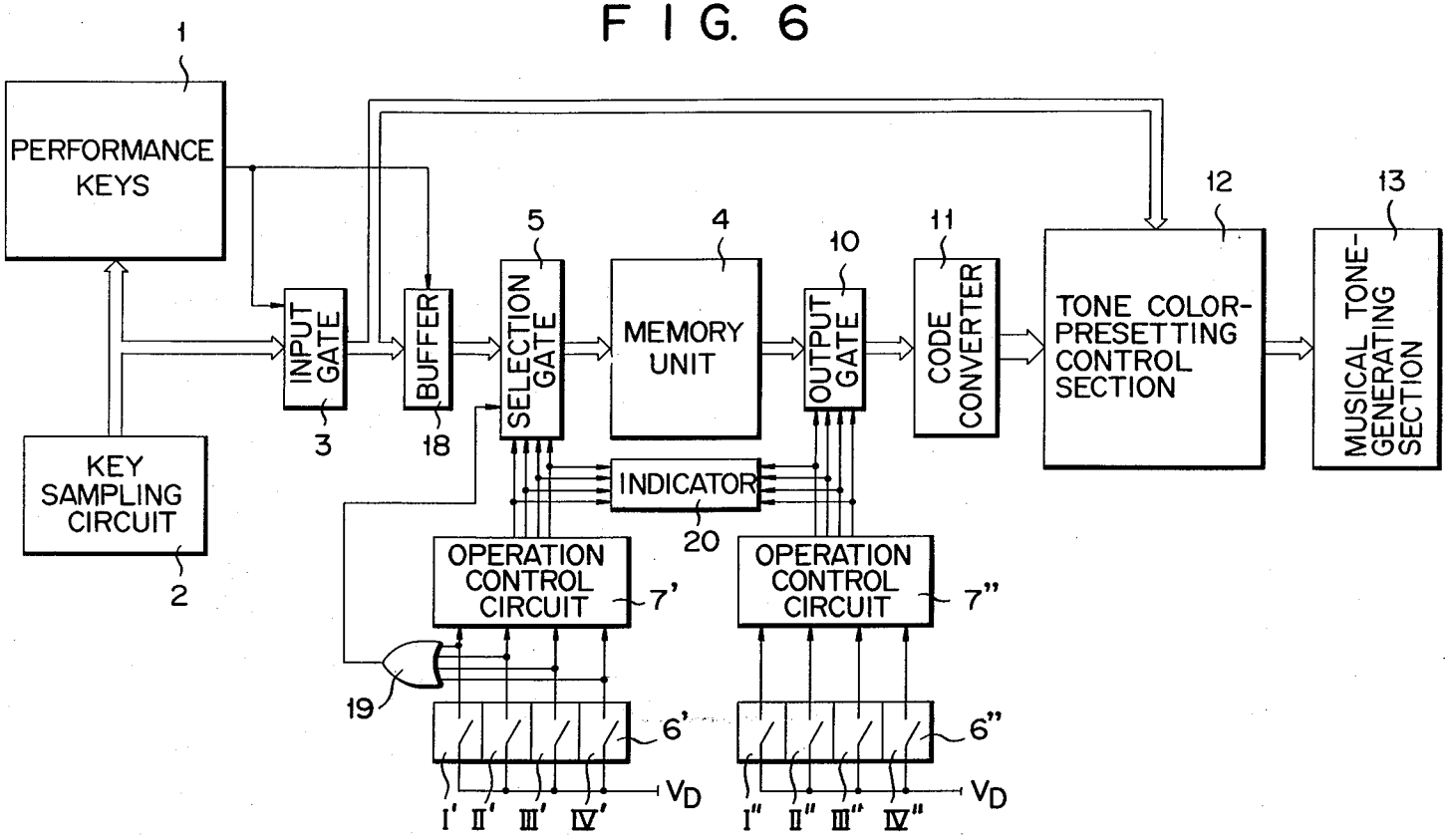

FIGS. 4 to 6 indicate an electronic musical instrument according to other embodiments of this invention. The parts of FIGS. 4 to 6 the same as those of FIG. 1 are denoted by the same numerals, description thereof being omitted. The embodiment of FIG. 4 is different from that of FIG. 1 in that the code converter 11 of FIG. 1 is replaced by a code converter 16 connected between the input gate group 3 and tone color selection gate group 5. Accordingly, the respective memory areas of the memory unit 4 are directly supplied with an n-bit tone color-presetting signal.

With the embodiment of FIG. 5, the memory unit 4 of FIG. 1 is formed of a random access memory (abbreviated as "RAM"). Accordingly, an operation instruction signal issued from the operation control circuit 7 is used as an instruction signal for specifying any of the addresses of the RAM. Where the Q output terminal of the flip-flop circuit 9 produces an output signal having a logic level of "0", a "write" instruction is supplied to the RAM. Where said Q output terminal sends forth an output signal having a logic level of "1", then a "read" instruction is given to the RAM. A coded signal delivered from the output terminal of any of the input gate group 3 is temporarily stored in a buffer memory 8 in synchronization with the operation of a performance key. In the case of FIG. 5, after a performance key is operated while a "write" instruction is issued from a memory unit or RAM 17, and the corresponding coded signal is stored in the buffer memory 18, the one of the tone color-specifying switches I, II, III, IV is operated to cause said coded signal to be written in the corresponding memory area of the RAM 17.

With the embodiment of FIG. 6, the tone color-specifying switches I, II, III, IV of the switch section 6 of FIG. 1 are exclusively used to write a coded signal in the respective memory areas of the memory unit 4 and read said signal therefrom. The switches I', II', III', IV' of a switch section 6' are used to select any tone color selection gate of the group 5. The switches I'', II'', III'', IV'' of a switch section 6'' are applied to select any output gate of the group 10. An instruction signal for operation of the switches I', II', III', IV' of the switch 6' is issued through an OR gate 19 to the tone color selection gate group 5 to let any gate thereof be opened. A coded signal read out of the buffer memory 18 of FIG. 6 (of the same type as that of FIG. 5) is written in the corresponding memory area in synchronization with the operation of any of the switches I', II', III', IV'. Output signals from the operation control circuits 7', 7'' are supplied to the indicator 20 to specify the switches I', II', III', IV' of the switch section 6' and the switches I'', II'', III'', IV'' of the switch section 6''.

Any performance key of the group 1 of FIG. 1 is concurrently used for the original performance and the presetting of a tone color.

Figure 7:
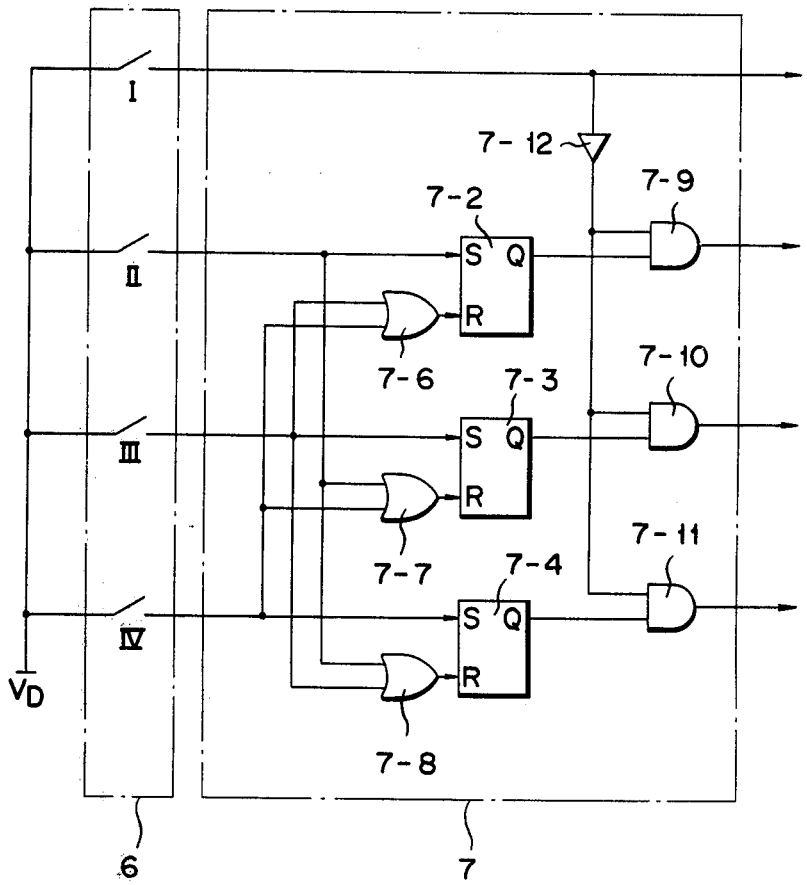
FIG. 7 indicates another embodiment of the operation control circuit of FIG. 1.

As is apparent from FIG. 7, it is possible to cause, for example, the switch I included in the switch I, II, III, IV of the switch section 6 to send forth a coded signal stored in the corresponding first memory area through any output gate of the group 10 to change tone colors, and upon release of the switch I, produce another tone color specified by, for example, the selected switch II. In FIGS. 1 and 4 the presetting of tone colors is effected by a performance key or exclusive tone color presetting key with the switch I operated. While thrown in, the switch I produces a coded signal. Output signals from the S-R flip-flop circuits 7-2 to 7-4 are drawn out through the corresponding AND gates 7-9 to 7-11. These AND gates 7-9 to 7-11 are supplied with a gate stop signal obtained by reversing a signal issued during the operation of the switch I by an inverter 7-12, and are prevented from producing an output signal, while the switch I is in operation.

Referring to FIGS. 1 to 7, a tone color-presetting element includes not only a direct n-bit coded signal supplied to the tone color-presetting control section 12 but also an indirect coded signal corresponding to an operated performance key before converted into said n-bit coded signal. In other words, the tone color-presetting element denotes not only the n-bit coded signal stored in the memory unit 4, but also, as naturally expected, a coded signal of a performance key before converted into an n-bit code.

A code converter used with the foregoing embodiments is not always required. Where the tone color-presetting element need not be formed of a coded signal having an n number of bits, then the respective bits of a 6-bit coded signal delivered from the key-sampling circuit can be used as a tone color-presetting element. Depending on the tone color-presetting condition, code conversion can be carried out in such a manner that a number of bits is decreased from the above-mentioned 6 bit conversely from the foregoing embodiments. The number of switches constituting the switch section 6 need not be limited to four (as I, II, III, IV). More switches than at least two can be provided if desired. Further, the switch need not be operated restrictively by hand, but by foot. Further, the switches I, II, III, IV of the switch section 6 may optionally consist of a push button type or touch type. The tone color-presetting means of the tone color-presetting control section 12 need not be restrictively formed of the aforesaid tone volume control section 12-1, tone color-generating section 12-2 and sound effect control section 12-3. Obviously, it is possible to increase or decrease a number of the constituent elements of said tone color-presetting means. What is required is to provide a sufficient number of tone color-presetting elements to preset a desired tone color.

There will now be described by reference to FIGS. 8–10B a method of automatically presetting an M number of tone colors selected from a larger number of tone colors in response to the operation of an initial tone color-presetting switch.

Figure 8:
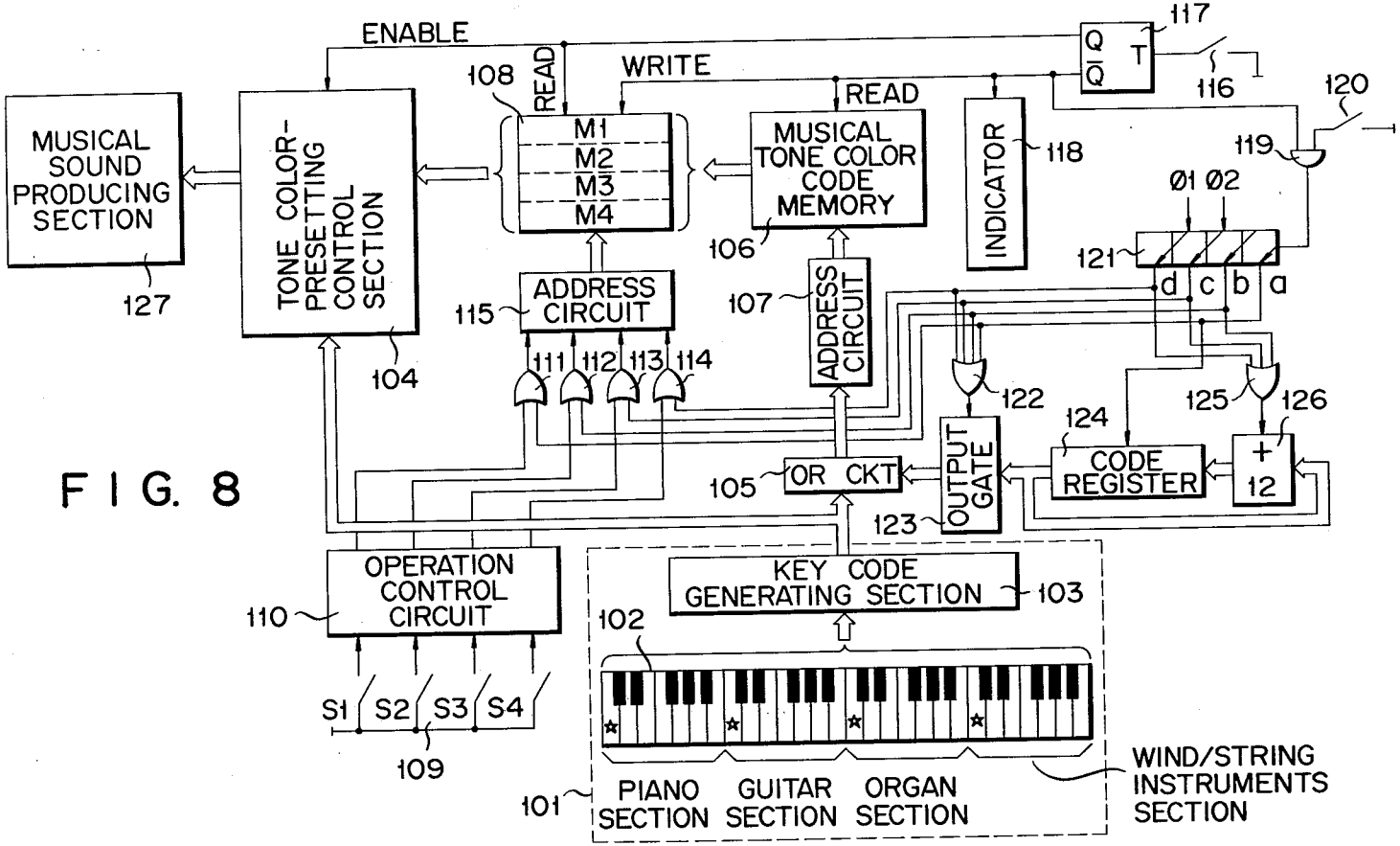
FIGS. 8 to 10B show the circuit arrangement of tone color-presetting systems each using an initial tone color-presetting switch.

Referring to FIG. 8, reference numeral 101 denotes a performance key signal input section, which comprises, for example, 48 performance keys 102 (corresponding to 12 scales×4 octaves) and a key code-generating section 103 which produces different coded signals corresponding to the respective performance keys. Referring to FIG. 8, each performance key is represented by a 6-bit coded signal. The key code-generating section 103 is connected to an address-specifying circuit 107 which designates any selected one of the addresses of the later described tone color code memory 106 through the tone color-presetting control section 104 (corresponding to 12 of FIG. 1) and OR circuit 105. The tone color code memory 106 is formed of, for example, a read only memory (abbreviated as "ROM") and is previously supplied with a large number (an N number) of tone colors in the form of a binary code. Information on each of said n number of tone colors is formed of an n number of bits. The respective tone colors are controlled by the tone color-presetting control section.

As seen in FIG. 8, the performance keys 102 are divided into four groups representing the tone colors of, for example, the piano series, guitar series, organ series and wind instrument series, each group being formed of twelve performance keys. All the performance keys are designated by decimal numerals of "0", "1", "2" . . . "48" as successively counted from the left side of FIG. 8. The addresses of the tone color code memory 106 are made to correspond to the performance keys designated by said numerals. A memory device 108 is of the RAM type and is provided with an M number of memory areas capable of storing coded signals denoting an M number ($N>M>1$) of tone colors. This RAM type memory device 108 is supplied with a smaller M number of tone colors selected from a larger N number of tone colors stored in the tone color code memory 106. Referring to FIG. 8, for example, four different tone colors are preset in the four 1st to 4th memory areas M1 to M4 of said RAM type memory device 108. These memory areas M1, M2, M3, M4 correspond to the switches S1, S2, S3, S4 of the tone color-selecting switch section 109 (the same as the switches I, II, III, IV of FIG. 1). Instruction signals for the operation of the switches S1, S2, S3, S4 are supplied to OR gates 111, 112, 113, 114 through an operation control circuit 110 (corresponding to 7 of FIG. 1) to specify the corresponding memory areas M1, M2, M3, M4.

Reference numeral 116 denotes a changeover switch for instructing a performance mode or a tone color-presetting mode. An output signal from the switch 116 is supplied to a flip-flop circuit 17 whose operation is reversed, each time said switch 116 is thrown in. A Q output signal from the flip-flop circuit 117 is conducted as a "read" instruction to the memory device 108, and also as an enable signal to the tone color-presetting control section 104. A $\overline{Q}$ output signal from the flip-flop circuit 117 is supplied as a "read" instruction to the tone color code memory 106 and also as a "write" instruction to the memory device 108. Where a Q output signal is issued from the flip-flop circuit 117, then any of the switches S1 to S4 specifies the corresponding memory area of the memory device 108. Thereafter, performance keys are operated to produce musical tones bearing the tone color stored in the specified memory area. Where a $\overline{Q}$ output signal is sent forth to the flip-flop circuit 117, then any of the switches S1 to S4 designates the corresponding one of the memory areas M1 to M4 of the memory device 108. At this time, a selected one of the performance keys 102 is operated to cause the corresponding tone color code signal to be read out of the tone color code memory 106 and written in the specified one of the memory areas M1 to M4 of the memory device 108. In other words, any of the performance keys 102 is used for performance when a Q output signal is issued for performance purpose from the flip-flop circuit 117 by operation of the changeover switch 116. Where a $\overline{Q}$ output signal from said flip-flop circuit 117 specifies a tone color-presetting mode, then any of the performance keys 102 is operated for the presetting of a desired tone color.

A $\overline{Q}$ output signal from the flip-flop circuit 117 is supplied to an indicator 118 to inform a player of the tone color thus preset, and also to one of the input terminals of an AND gate 119. An output signal from an initial tone color presetting switch 120 is supplied to the other terminal of the AND gate 119, and also to a 4-bit shift register 121 through said AND gate 119. Output signals, a, b, c, d from the respective bit sections of the shift register 121 are conducted to the corresponding OR gates 111, 112, 113, 114 to specify the memory areas M1, M2, M3, M4 of the memory device 108. The output signals a, b, c, d are also supplied as gate opening signals to an output gate circuit 123 through an OR gate 122. The output signal a from the shift register 121 is supplied as a reset instruction to a tone color code register 124. Output signals b, c, d are supplied as signals instructing an addition of 12 to a "12" adder 126 through an OR gate 125. An output signal from the tone color code register 124 is also delivered to the "12" adder 126. Accordingly, each time the output bit signals a, b, c, d are sent forth from the shift register 121, 6-bit code signals corresponding to decimal numerals "0", "12", "24" and "36" are issued from the output gate circuit 123 and supplied to the address-specifying circuit 107 through the OR description thereof being omitted. Among the n-bit information specifying tone color-presetting elements stored in the specified memory areas of the memory device 108, output signals having an n1 number of bits (n>n1), an n2 number of bits (n>n2) and an n3 number of bits (n>n3) are respectively supplied to the tone volume control section 12-1, tone color-generating section 12-2 and sound effect control section 12-3. An output coded signal from the key code-generating section 103 which corresponds to an operated performance key is supplied to the input key code memory section 12-4. An enable signal from the Q output terminal of the flip-flop circuit 117 which indicates a performance mode is sent forth to the tone color-generating section 12-2.

There will now be described the function of a tone color-presetting system arranged as described above. Now let it be assumed that before performance, the flip-flop circuit 117 is arranged for a tone color-presetting mode by operation of the changeover switch 116. Output signals a, b, c, d from the shift register 121 specify the memory areas M1, M2, M3, M4 of the memory device 108. At this time, 6-bit coded signals corresponding to the output signals from the tone color code register 124 which denote "0", "12", "24", and "36" are generated from the output gate circuit 123, thereby specifying the corresponding circuit 105. In other words 6-bit code signals corresponding to the decimal numerals "0", "12", "24" and "36" are used as address signals for specifying the selected ones of an N number of tone colors stored in the tone color code memory 106. Said numerals "0", "12", "24" and "36" correspond to code signals denoting those of the performance keys 102 which are marked by an asterisk. Where the initial tone color-presetting switch 120 is operated, then the addresses of the tone color code memory 106 are specified which correspond to the typical tone color of each of four musical instruments, for example, the piano, guitar, organ and wind instrument. As a result, n-bit data on said four typical tone colors are written in the corresponding memory areas M1 to M4 of the memory device 108.

The tone color-presetting control section 104 controls the generation of a particular tone color in accordance with the contents of tone color-specifying information stored in any of the four memory areas M1 to M4 of the memory device 108. Where a performance mode is prescribed by operation of the changeover switch 116, musical tones bearing the specified tone color are produced by operation of performance keys 102 through a sound-producing section 127 (corresponding to the second-generating section 13 of FIG. 1). The tone color-presetting control section 104 has the same concrete arrangement as shown in FIG. 3, addresses of the tone color code memory 106. Therefore, a single operation of the initial tone color-presetting switch 120 enables the n-bit information specifying the tone color-presetting elements which is issued from the tone color code memory 106 to be written in the memory areas M1 to M4 of the memory device 108. In other words, signals denoting the tone colors corresponding to those of the performance keys 102 which are marked by an asterisk are preset in the memory device 108.

Where a player wants to play musical tones bearing a different tone color from that which is previously preset by operation of the initial tone color-presetting switch 120, then he operates a desired switch, for example, a switch S1, and thereafter a desired one of the performance keys 102 which corresponds to the selected color-presetting elements, thereby causing the corresponding tone color signal stored in the tone color code memory 106 to be written in the first memory area M1 of the memory device 108. Where necessary, the player operates the switch S2 and thereafter a desired performance key, causing the corresponding tone color read out of the tone color code memory 106 to be written in the second memory area of the memory device 108. If necessary, signals denoting other desired tone colors are written in the memory areas M3, M4 specified by the switches S3, S4 in the same manner as described above. In other words, where it is desired to make an effective dynamic performance by converting during performance the currently played musical tones bearing a given tone color into those having a different tone color, then a signal representing said different tone color is written in a specified memory area of the memory device 108.

When a signal representing a desired tone color is written in the memory device 108, the changeover switch 116 is operated to reverse the operation of the flip-flop circuit 117, thereby issuing a performance instruction to render an electronic musical instrument ready for performance. Where, for example, the switch S1 is specified to produce musical tones having an initial tone color, then the n-bit information specifying particular tone color-presetting elements which is previously stored in the first memory area M1, of the memory device 108 is supplied to the tone color-presetting control section 104. Therefore, a player can play musical tones bearing the desired tone color. Where, during performance, a player wants to convert musical tones having a given tone color into those which have a different tone color in order to elevate a performance effect, then he operates a different switch (for example, a switch S3) from the currently used switch S1. Then a performance is carried out with the tone color stored in the third memory area M3 specified by said switch S3.

Figure 9:
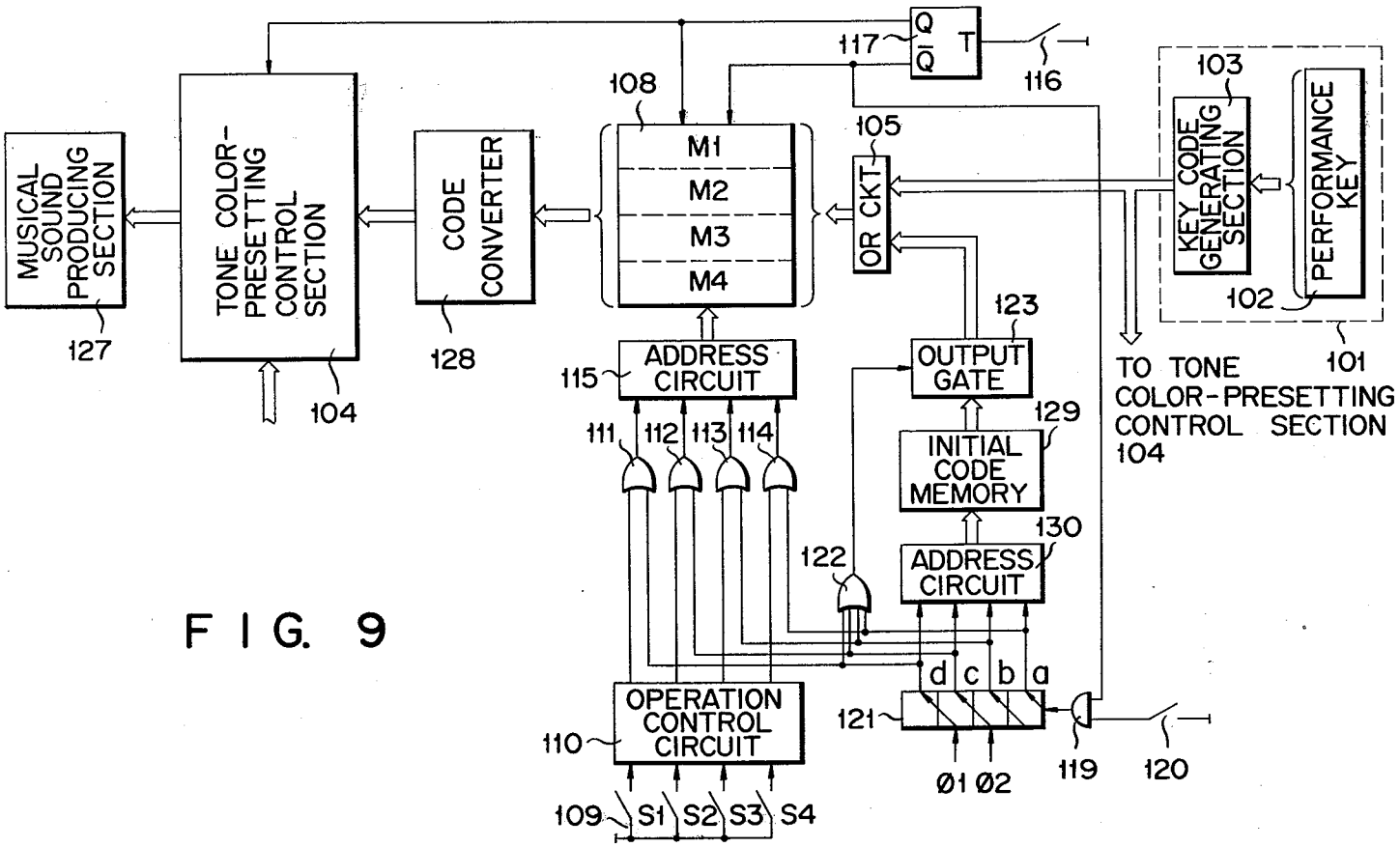

There will now be described by reference to FIG. 9 an electronic musical instrument according to another embodiment of this invention. The parts of FIG. 9 the same as those of FIG. 8 are denoted by the same numerals, description thereof being omitted. Referring to FIG. 9, a key code corresponding to any of the performance keys 102 is written in the memory device 108 through the OR circuit 105. The n-bit information specifying the particular tone color-presetting elements is supplied to the tone color-presetting control section 104 through the code converter 128. This code converter 128 is, for example, the ROM type and converts a 6-bit key code read out of the memory device 108 into an n-bit code. Reference numeral 129 denotes an initial code memory, which is supplied with four key codes corresponding to the aforesaid four typical tone colors. Output signals a, b, c, d from the shift register 121 specify the addresses of an address circuit 130. Said output signals a, b, c, d are written in the corresponding memory areas M1, M2, M3, M4 of the memory device 108 through the OR circuit 105.

Figure 10A:
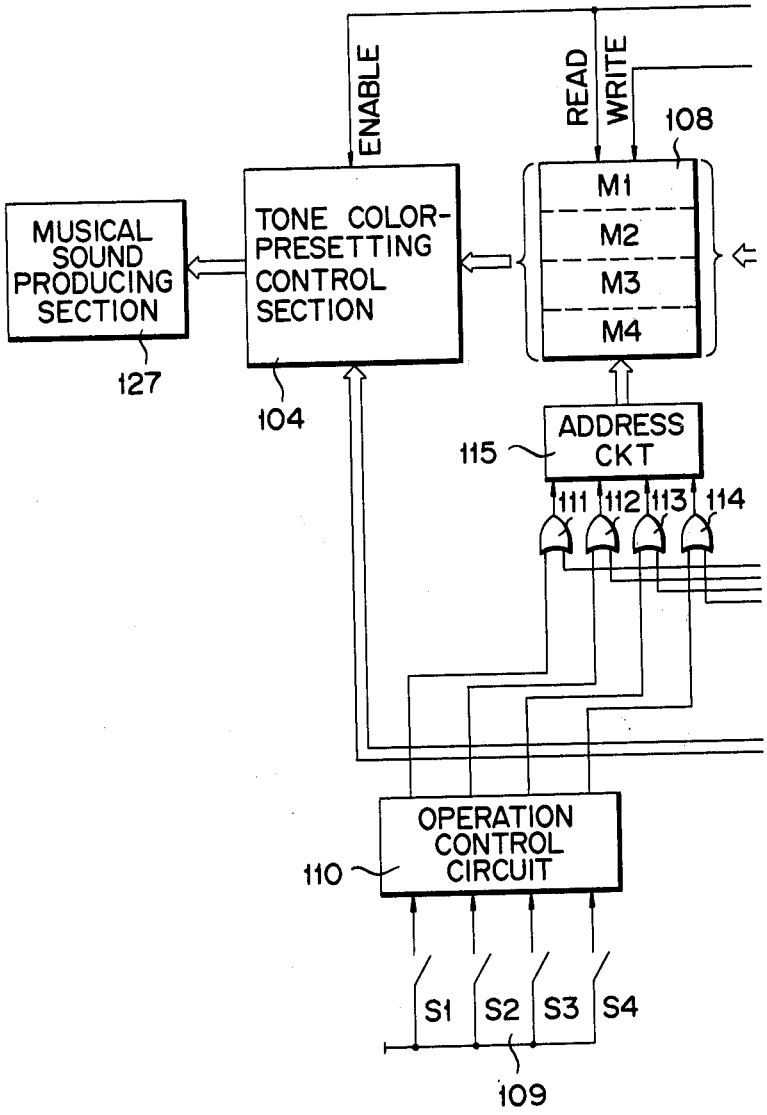
Figure 10B:
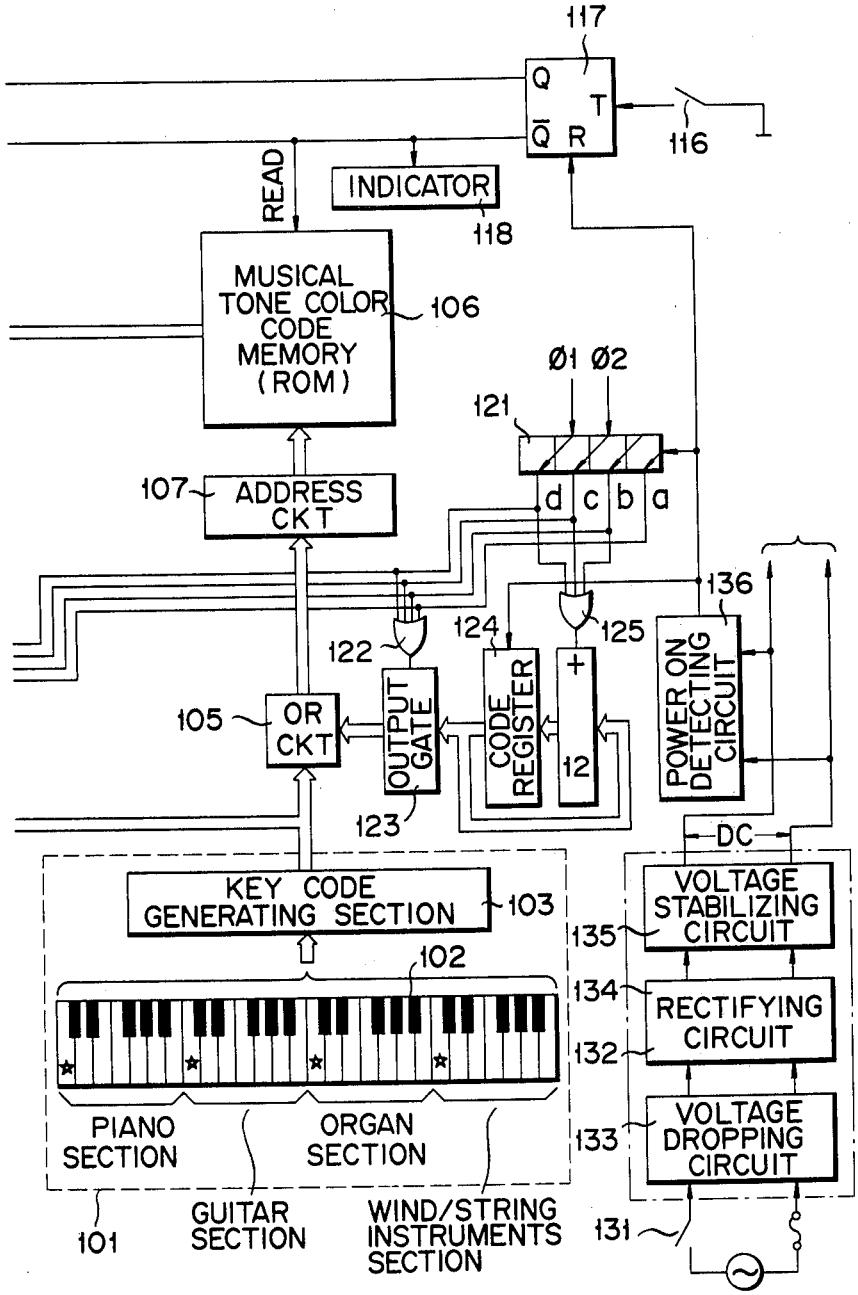

There will now be described by reference to FIGS. 10A and 10B an electronic musical instrument according to still another embodiment of this invention. The parts of FIGS. 10A and 10B the same as those of FIG. 8 are denoted by the same numerals, description thereof being omitted. With the embodiment of FIGS. 10A and 10B, the initial tone color-presetting switch 120 of FIGS. 8 and 9 is fundamentally applied as a power supply switch 131. When a power source is put into operation, the n-bit information specifying the particular tone color-presetting elements which is read out of the tone color code memory 106 is automatically written in the memory device 108. Reference numeral 132 shows a power supply circuit, which comprises the ordinary voltage-dropping circuit 133, rectifier 134 and voltage stabilizing circuit 135. When the power supply switch 131 is thrown in, a direct current is supplied. An output from the power supply circuit 132 is conducted to every section of FIG. 10B and also to a power ON-detecting circuit 136. When the supply switch 131 is thrown in, an output signal from the power ON-detecting circuit 136 is conducted as a reset signal to the flip-flop circuit 117, as an input signal to the shift register 121 and as a reset signal to the tone color code register 124.

Throughout the embodiments of FIGS. 8 to 10B, the initial tone color-presetting switch 120 concurrently acts as a power supply switch 131. A single operation of said switch 120 enables an M number of tone colors selected from an N number thereof to be automatically stored in the memory device 108.

With the embodiments of FIGS. 8 to 10B, any desired one of the tone colors of the piano series, guitar series, organ series and wind instrument series is written in the memory device 108 by operation of the initial tone color-presetting switch 120. With the electronic musical instrument of this invention, however, the tone color of any other musical instrument can be preset. Further with the foregoing embodiments, a performance key was concurrently used for performance and the presetting of a tone color, with a selected tone color represented by the performance key. However, it is possible to provide separate keys for the presetting of desired tone colors. The memory device 108 need not be provided with restrictively four memory areas. The point is that the memory areas should be provided in a smaller M number than an N number. The initial tone color-presetting switch need not be restricted to only one, but may be provided in plurality. In such case, it is advised to use each tone color-presetting switch for a plurality of tone colors. The number of performance keys mounted on the keyboard of the ordinary electronic musical instrument does not always correspond to the N number of all desired tone colors. In other words, the performance keys may be provided in a larger number than that of the tone colors.

The arrangements of the foregoing embodiments simply indicate the basic principle by which the electronic musical instrument of this invention is operated. It will be noted that the invention is not limited to said embodiments, but can obviously be applied in various modifications without departing from the scope and object of the invention.

What is claimed is:

1. An electronic musical instrument comprising:

first memory means having a large plurality of tone color memories for storing tone color information in the form of binary codes, said tone color information comprising a plurality of data elements for determining various tone colors, the respective data elements being stored in the respective tone color memories;

second memory means for reading said tone color information from at least one of said tone color memories of said first memory means and for storing said tone color information;

selecting means coupled to said second memory means for selecting one data element for determining a desired tone color from said tone color information stored in said second memory means; and means coupled to said second memory means for producing a musical tone of the tone color determined by the tone color information thus selected.

2. An electronic musical instrument comprising:

first memory means having a large plurality of tone color memories for storing tone color information in the form of binary codes, said tone color memories being allotted respective code numbers, said tone color information comprising a plurality of data elements for determining various tone colors;

second memory means for reading some of the code numbers allotted to said tone color memories of said first memory means and for storing the code numbers thus read out;

selecting means for selecting one of the code numbers stored in said second memory means; and means for producing a musical tone of the tone color determined by the tone color information which is stored in the tone color memory to which the code number thus selected is allotted.

3. The electronic musical instrument of claim 1 or 2, wherein said first memory means comprises a code converter.

4. The electronic musical instrument of claim 1 or 2, wherein said first memory means comprises a ROM (read only memory).

5. The electronic musical instrument of claim 1 or 2, further comprising respective keys coupled to said tone color memories of said first memory means, and means for selectively designating the tone color memories of said first memory means responsive to operation of said keys.

6. The electronic musical instrument of claim 5, wherein said keys are performance keys of a keyboard.

7. The electronic musical instrument of claim 6, wherein said keys are white performance keys of a keyboard.

8. The electronic musical instrument of claim 1 or 2, wherein said first memory means comprises a ROM (read only memory); and said second memory means comprises a RAM (random access memory).

9. The electronic musical instrument of claim 2, wherein said first memory means comprises a ROM (read only memory); and said code numbers which are allotted to said tone color memories correspond to the addresses of the ROM, each storing tone color information.

10. The electronic musical instrument of claim 9, comprising keys provided for the respective addresses of said ROM, and wherein said code numbers are designated when said keys provided respectively for the addresses of said ROM are operated.

11. The electronic musical instrument according to claim 10, wherein said keys are performance keys of a keyboard.

12. The electronic musical instrument of claim 1, wherein there are N tone color memories, and further comprising a switch for designating M of said N tone color memories, where M and N are integral numbers and M is much smaller than N and larger than 1; and means for writing the tone color information stored in the M tone color memories into said second memory means when said switch is operated.

13. The electronic musical instrument of claim 12, wherein M is the number of data elements of the tone colors which may be stored in said second memory means at a time.

14. The electronic musical instrument of claim 12, wherein said switch is a power supply switch.

15. The electronic musical instrument of claim 2, wherein there are N of said code numbers, and further comprising a switch for designating M of said N code numbers allotted to the tone color memories, where M and N are integral numbers and M is much smaller than N and larger than 1; and means is provided for connecting the M code numbers into said second memory means when said switch is operated.

16. The electronic musical instrument of claim 15, wherein M is the number of code numbers which may be stored in said second memory means at a time.

17. The electronic musical instrument of claim 15, wherein said switch is a power supply switch.

18. An electronic musical instrument comprising:

first memory means having a large plurality of memory sections for storing tone color information in the form of binary codes, said tone color information comprising a plurality of data elements for determining various tone colors;

second memory means having far fewer memory sections than said first memory means;

selecting means for reading the tone color information from at least one of the memory sections of said first memory means and for writing said readout tone color information into one of the memory sections of said second memory means, for selecting the tone color information stored in said second memory means; and means coupled to said second memory means for producing a musical tone of the tone color determined by the tone color information thus selected.

19. An electronic musical instrument comprising:

first memory means having a large plurality of memory sections for storing tone color information in the form of binary codes, said memory sections being allotted respective code numbers, said color information comprising a plurality of data elements for determining various tone colors;

second memory means having far fewer memory sections than said first memory means;

means for selecting some of the code number allotted to the memory sections of said first memory means and for writing the code numbers thus selected into said second memory means;

means for selecting one of the code numbers stored in said second memory means; and means for producing a musical tone of the tone color determined by the tone color information which is stored in the memory section of the first memory means to which the code number thus selected is allotted.

20. The electronic musical instrument of claim 18 or 19, wherein said first memory means comprises a code converter.

21. The electronic musical instrument of claim 18 or 19, wherein said first memory means comprises a ROM (read only memory).

22. The electronic musical instrument of claim 18 or 19, further comprising respective keys coupled to said memory sections of said first memory means, and means for selectively designating the tone color sections of said first memory means responsive to operation of said keys.

23. The electronic musical instrument of claim 22 wherein said keys are performance keys of a keyboard.

24. The electronic musical instrument of claim 18 or 19, wherein said first memory means comprises a ROM (read only memory); and said second memory means comprises a RAM (random access memory).

* * * * *